US007377231B2

(12) United States Patent
Tsai

(10) Patent No.: US 7,377,231 B2
(45) Date of Patent: May 27, 2008

(54) RETRACTABLE PET HOUSE

(76) Inventor: Ming-Liang Tsai, 4F-3, No. 8, Fu Ching St., Taipei (TW)

( * ) Notice: Subject to any disclaimer, the term of this patent is extended or adjusted under 35 U.S.C. 154(b) by 163 days.

(21) Appl. No.: 11/255,687

(22) Filed: Oct. 19, 2005

(65) Prior Publication Data

US 2007/0084492 A1 Apr. 19, 2007

(51) Int. Cl.
*A01K 1/03* (2006.01)
*E04H 15/36* (2006.01)

(52) U.S. Cl. ..... 119/499; 119/474; 119/498; 135/135; 135/158; 135/159

(58) Field of Classification Search ..... 119/498, 119/499, 474; 135/125, 139; 446/487; D21/834
See application file for complete search history.

(56) References Cited

U.S. PATENT DOCUMENTS 1,853,367 A * 4/1932 Mace ..... 135/123
2,865,387 A * 12/1958 Annibaldi ..... 135/145
3,064,667 A * 11/1962 Marino ..... 135/131
5,331,777 A * 7/1994 Chi-Yuan ..... 52/64
5,423,341 A * 6/1995 Brady ..... 135/139
6,499,705 B1 * 12/2002 Tsai ..... 248/167
6,520,196 B2 * 2/2003 Carter ..... 135/145
6,708,707 B2 * 3/2004 Dotterweich et al. ..... 135/131
6,848,461 B2 * 2/2005 Tsai ..... 135/131
2001/0015218 A1 * 8/2001 Carter ..... 135/126
2006/0236952 A1 * 10/2006 King ..... 119/499

* cited by examiner

*Primary Examiner*—Peter M. Poon
*Assistant Examiner*—Kristen C. Hayes
(74) *Attorney, Agent, or Firm*—WPAT, P.C.

(57) ABSTRACT

A retractable pet house includes an enclosure frame and an optional top frame. The enclosure frame includes a plurality of poles, foldable connection rod units and locking joints. The upper end and the lower end of each pole are connected to the locking joints. The upper ends and the lower ends of both sides of the foldable connection rod unit are respectively pivoted to the locking joints. The top frame includes a central joint and a plurality of top rods. Each top rod has one end pivoted to the central joint and another end penetrating through the locking joint at the upper end of each pole. One end of each top rod is provided with a threaded hole for receiving a bolt to hold against the central joint. The inclination between the top frame and the central joint is variable by rotating the bolts.

1 Claim, 6 Drawing Sheets

RETRACTABLE PET HOUSE

BACKGROUND OF THE INVENTION (a) Field of the Invention

The present invention relates to a retractable pet house, and more particularly, to an enclosure frame including multiple railings, or further incorporated with a top frame to be adapted with a tent in a variety of polygonal styles. The inclination of the top frame is adjustable.

(b) Description of the Prior Art

Pet houses generally available in the market are roughly classified into two types, fixed and collapsible with the former generally used at home and the latter, outdoors. However, the construction of a collapsible pet house is limited to rectangular or semi-columnar one, which is not convenient for assembly and disassembly. Furthermore, the style of either form of construction including the inclination of the top frame is impossible to have any significant change even provided with additional components.

SUMMARY OF THE INVENTION

The primary purpose of the present invention is to provide a retractable pet house composed of an enclosure frame combined with multiple railings or an additional top frame and a tent are provided so that the enclosure frame allows to be retracted for storage and the top frame permits adjustment of its inclination; accordingly, the pet house may be made in any polygonal style with space variable to suit best the use by the pet and make it easier for the pet owner to maintain and operate.

A preferred embodiment of the present invention comprises an enclosure frame including a plurality of poles, foldable connection rod units and locking joints. Each pole includes an upper end and a lower end fixed to the relative locking joints, and the locking joint at the upper end of each pole is further provided with a sleeve. The poles are alternatively distributed while each foldable connection rod unit is composed of two connection rods pivoted to each another. Each foldable connection rod unit has an upper end and a lower end on each of both sides respectively pivoted to the locking joints at the upper end and the lower end of the pole.

Each foldable connection rod unit includes two connection rods. Each connection rod includes an upper end, a middle section and a lower end with the connection rods pivoted to each other at their middle sections. The upper ends and the lower ends of the connection rods are the upper ends and the lower ends of the foldable connection rod unit.

One foldable connection rod unit includes two longer rods and two shorter rods; and the enclosure frame further includes doorframe joints to be fixed to the center section of the poles. Each longer rod includes an upper end, a middle section and a lower end; and each shorter rod includes an upper end and a lower end. The longer rods are pivoted to each other at their upper ends; and the lower ends of the shorter rods are pivoted to the middle sections of the longer rods. The upper ends of the shorter rods are the upper ends of the foldable connection rod unit; and the lower ends of the longer rods are the lower ends of the foldable connection rod unit. The lower ends of the longer rods are pivoted to the doorframe joints.

Another preferred embodiment of the retractable pet house of the present invention includes an enclosure frame and a top frame. The enclosure frame includes a plurality of poles, foldable connection rod units and locking joints. Each pole includes an upper end and a lower end fixed to the relative locking joints. The locking joint at the upper end of each pole is provided with a sleeve. The poles are alternatively distributed with the foldable connection rod units pivoted to one another by means of connection rods. Each foldable connection rod unit includes on each of both sides an upper end and a lower end with both upper ends and both lower ends on both sides of the foldable connection rod units respectively pivoted to the locking joints at the upper ends and the lower ends of the poles. The top frame includes a central joint and a plurality of top rods. Each top rod includes two ends with one end pivoted to the central joint and another end penetrating through the sleeve pivoted to the locking joint at the upper end of the pole.

Each foldable connection rod unit includes two connection rods; each connection rod includes an upper end, a middle section and a lower end with both connection rods pivoted to each other at their middle sections. The upper ends and the lower ends of the connection rods are the upper ends and the lower ends of the foldable connection rod unit.

One foldable connection rod unit includes two longer rods and two shorter rods; and the enclosure frame further includes doorframe joints fixed to the lower sections of the poles. Each longer rod includes an upper end, a middle section and a lower end; and each shorter rod includes an upper end and a lower end. Both longer rods are pivoted to each other at their upper ends. The lower ends of the shorter rods are pivoted to the middle sections of the longer rods. The upper ends of the shorter rods are the upper ends of the foldable connection rod unit; and the lower ends of the longer rods are the lower ends of the foldable connection rod unit. The lower ends of the longer rods are pivoted to the doorframe joints.

Each top rod is provided with a threaded hole at one end for receiving a bolt to hold against the central joint of the top frame so that the inclination between the top frame and the central joint is variable by rotating the bolts against the central joint.

Accordingly, the present invention provides the following advantages:

1. It serves dual purposes of functioning as a pet house and an enclosure.
2. It allows a variety of styles, space, and the inclination of the top frame to suit better as a pet house.
3. It permits easy operation by the pet owner.
4. It saves space when retracted for storage at home.

DETAILED DESCRIPTION OF THE PREFERRED EMBODIMENTS

Figure 1:
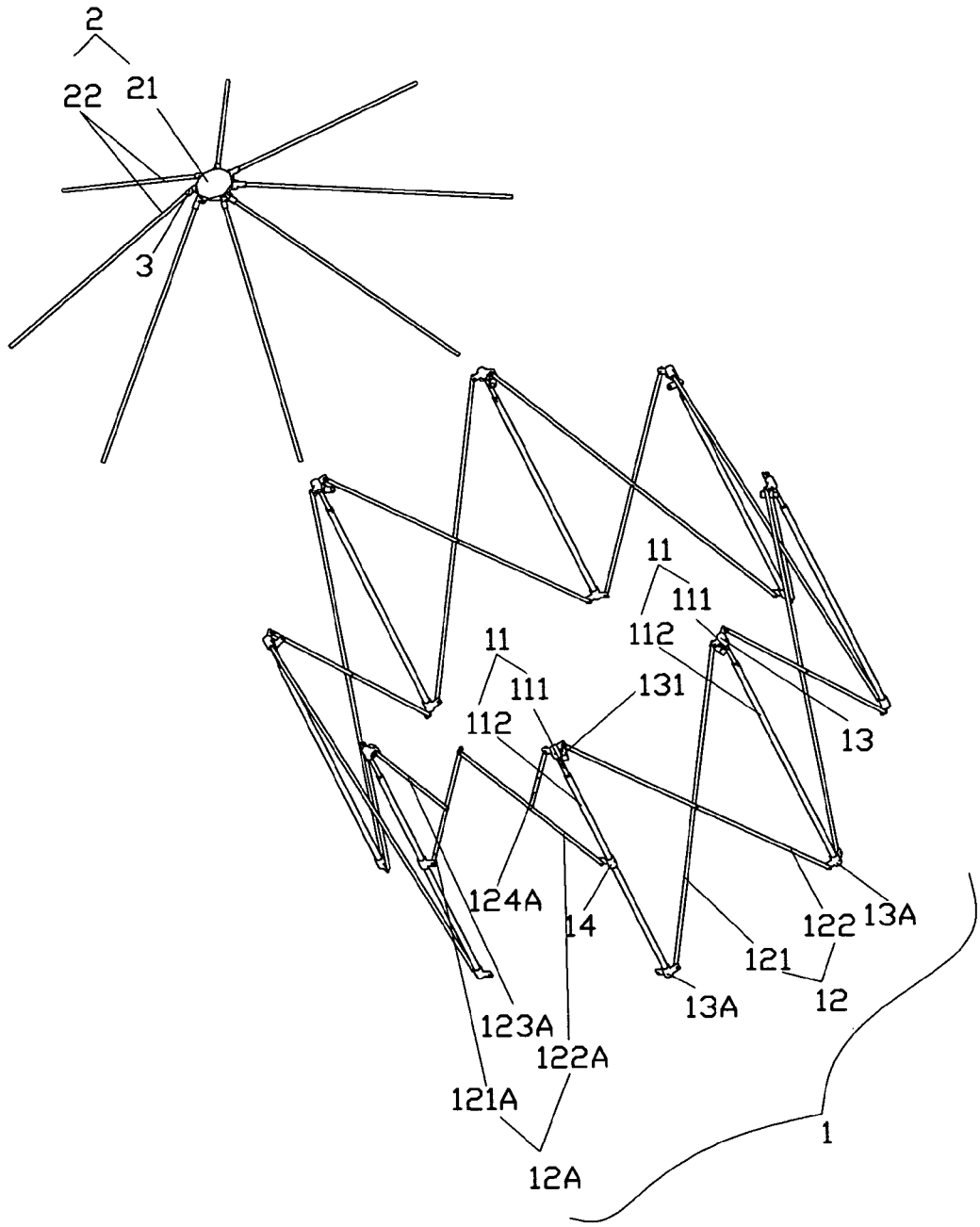
FIG. 1 is an exploded view of the present invention.
Figure 2:
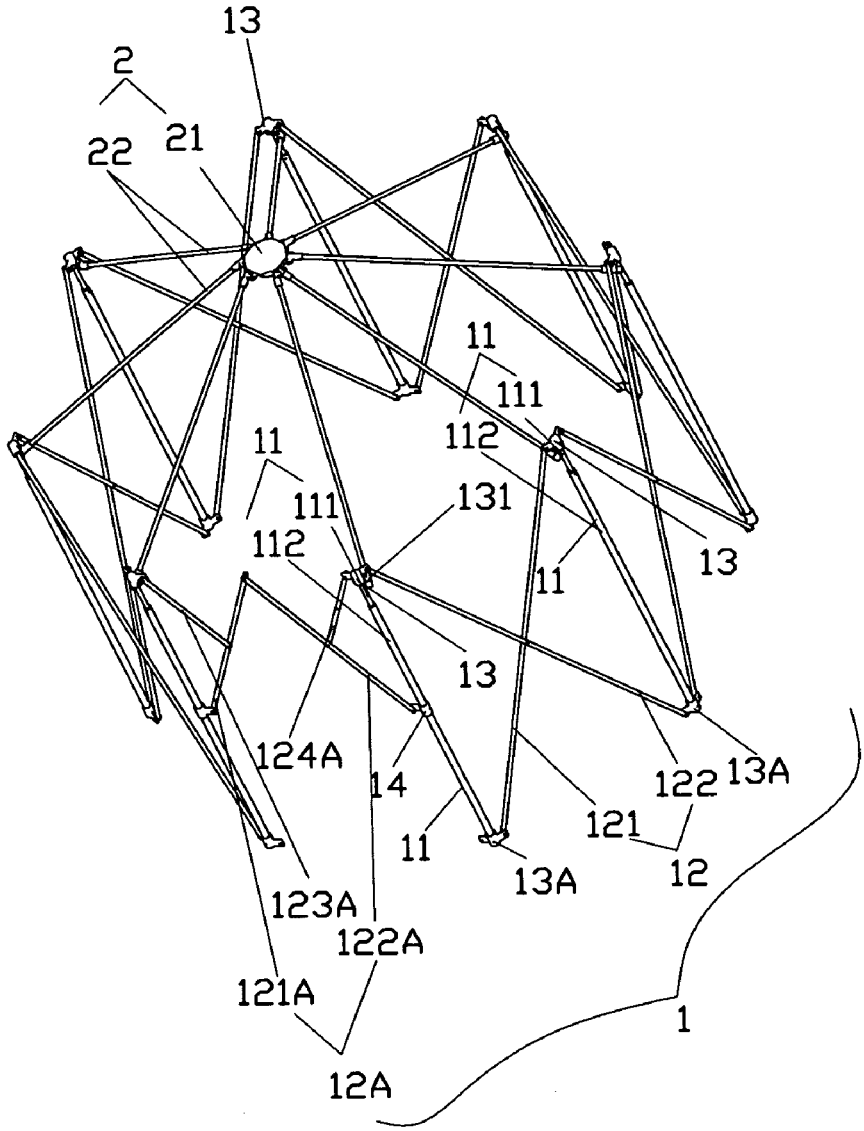
FIG. 2 is a perspective view of the present invention.

Referring to FIGS. 1 and 2, a preferred embodiment of the present invention for a retractable pet house comprises an enclosure frame (1) alone when operating as an enclosure, and a top frame (2) in conjunction with a tent (not illustrated) when operating as a roofed pet house. It is to be noted that both structures respectively for the enclosure and the pet house of both preferred embodiments illustrated in the accompanying drawings are put together, and that in practical application, the appropriate one shall govern.

As illustrated in FIGS. 1 and 2, the enclosure frame (1) includes a plurality of poles (11), foldable connection rod units (12, 12A), and locking joints (13, 13A).

Each pole (11) includes an upper pole (111) and a lower pole (112) with the former inserted into the latter and becoming retractable. Each pole (11) includes an upper end (the upper end of the upper pole (111) in the preferred embodiment) and a lower end (the lower end of the lower pole (112) in the preferred embodiment). Both the upper end and the lower end of each pole (11) are respectively fixed to their relative locking joints (13, 13A). The locking joint (13) provided at the upper end of each pole (11) is provided with a sleeve (131). The poles (11) are alternatively distributed to define an enclosed area in triangle, quadrilateral, pentagon, or any other polygon. The foldable connection rod units (12, 12A) are pivotally connected to each other by means of connection rods. The foldable connection rod units (12, 12A) include an upper end and a lower end on each of both sides while the foldable connection rod unit (12) has its upper end and lower end on each of both sides respectively pivoted to the locking joints (13, 13A) of the pole (11).

The top frame (2) includes a central joint (21) and a plurality of top rods (22). Each top rod (22) includes one end pivoted to the central joint (21) and another end penetrating through the sleeve (131) of the locking joint (13) on the pole (11).

Each foldable connection rod unit (12) includes two connection rods (121, 122) with each containing an upper end, a middle section, and a lower end. The connection rods (121, 122) are pivoted to each other at their middle sections, and the upper ends and the lower ends of the connection rods (121, 122) are the upper ends and the lower ends of the foldable connection rod unit (12).

The foldable connection rod unit (12A) includes two longer rods (121A, 122A) and two shorter rods (123A, 124A). Each of the longer rods (121A, 122A) includes an upper end, a middle section, and a lower end. The enclosure frame (1) further includes doorframe joints (14) fixed to the lower poles (112) of the poles (11). Each of the shorter rods (123A, 124A) includes an upper end and a lower end. The longer rods (121A, 122A) are pivoted to each other at their upper ends; and the lower ends of the two shorter rods (123A, 124A) are respectively pivoted to the middles sections of the two longer rods (121A, 122A). The upper ends of the shorter rods (123A, 124A) are the upper ends of both sides of the foldable connection rod unit (12A); and the lower ends of the longer rods (121A, 122A) are the lower ends of both sides of the foldable connection rod unit (12A). The lower ends of the longer rods (121A, 122A) are pivoted to the doorframe joints (14).

Figure 3:
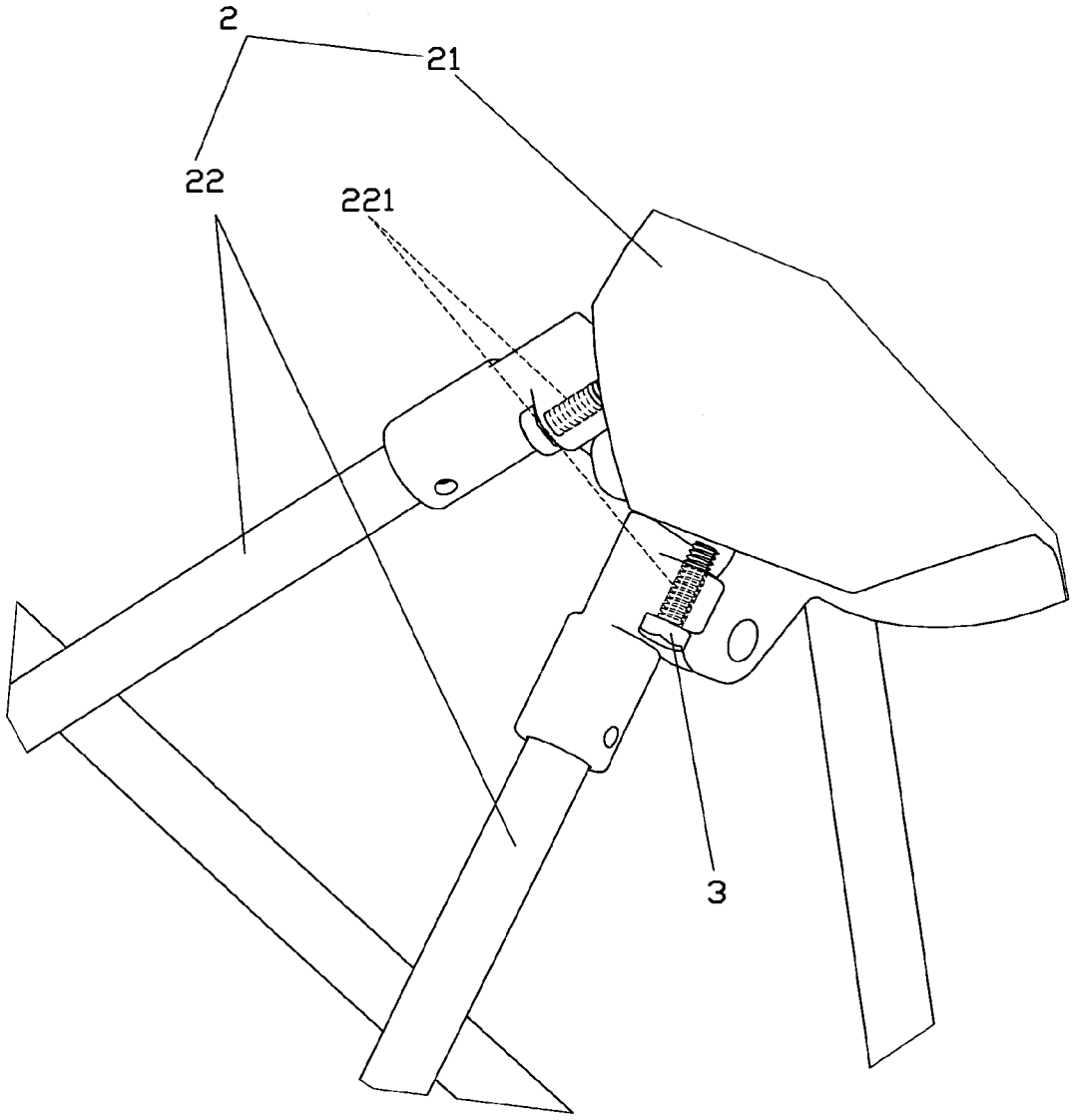
FIG. 3 is a schematic view of the adjustable top frame inclination of the present invention on the central joint.

The top frame adjustment for the pet house of the present invention includes the enclosure frame (1), the top frame (2) and a plurality of bolts (3). The enclosure frame (1) includes the poles (11) and the locking joints (13) with the poles (11) fixed to the locking joints (13). Each of the locking joints (13) is provided with the sleeve (131). The top frame (2) includes the central joint (21) and a plurality of top rods (22). Each top rod (22) includes two ends with one end pivoted to the central joint (21) at a certain inclination and another end penetrating through the sleeve (131) of the locking joint (13) on the pole (11). As shown in FIG. 3, each top rod (22) is provided with a threaded hole (221) at one end for receiving a relative bolt (3) to hold against the central joint (21) so as to secure the inclination.

Figure 6:
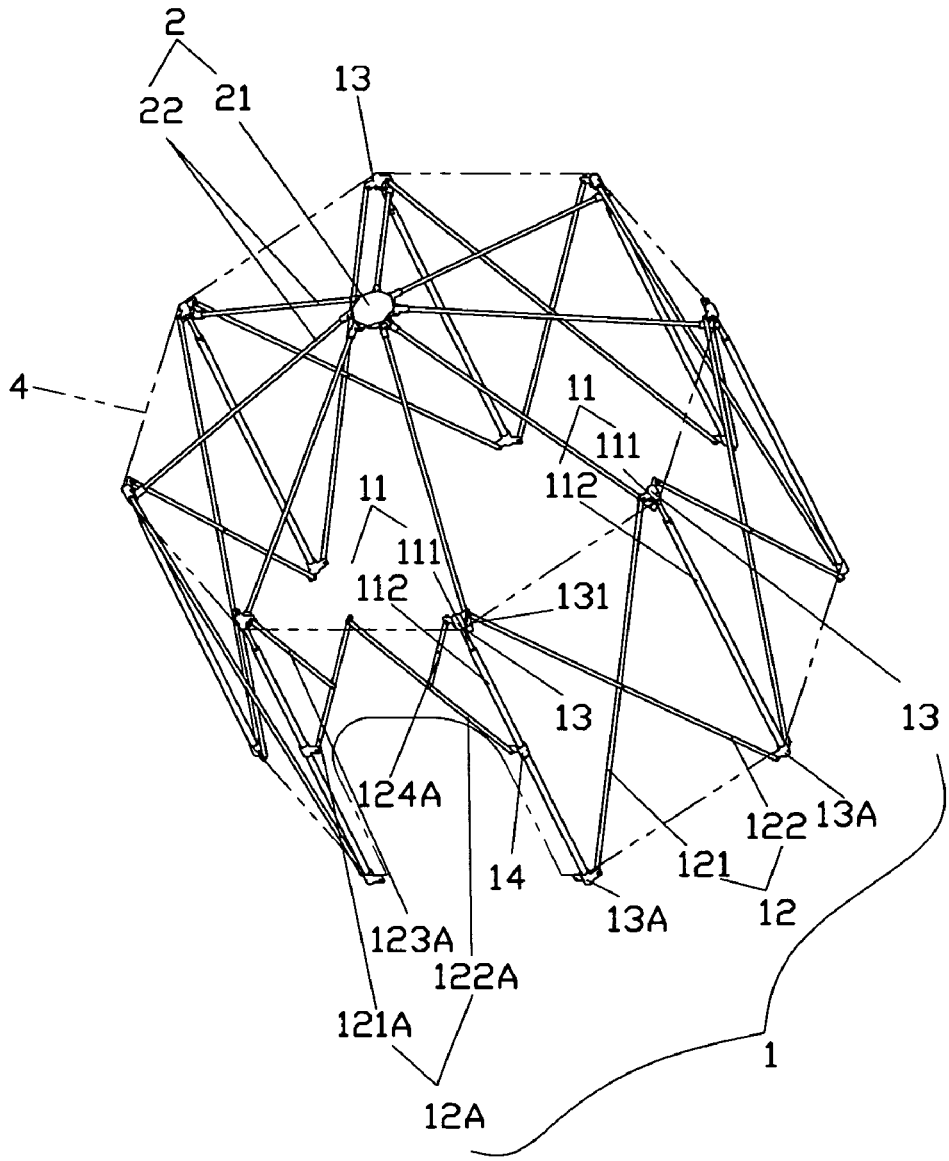
FIG. 6 is a schematic view showing a preferred embodiment of the present invention.

In practice as illustrated in FIG. 2 with the enclosure frame (1) and the top frame (2) stretched up for assembly, the tent (4) is covered thereupon to complete a pet house with an entrance as illustrated in FIG. 6. Meanwhile, the foldable connection rod units (12) and the tent (4) substantially constitute the walls of the pet house. The foldable connection rod unit (12A) of the enclosure frame (1) substantially constitutes the entrance of the pet house.

Without the tent (4), the present invention functions also as an enclosure. However, this is not the normal application by referring to FIG. 1 and no accompanying drawing is provided since it relates only to a provisional choice made by the user. It is taken for granted that multiple poles (11) and foldable connection rod units (12) are provided to achieve the purposes of the present invention.

Figure 4:
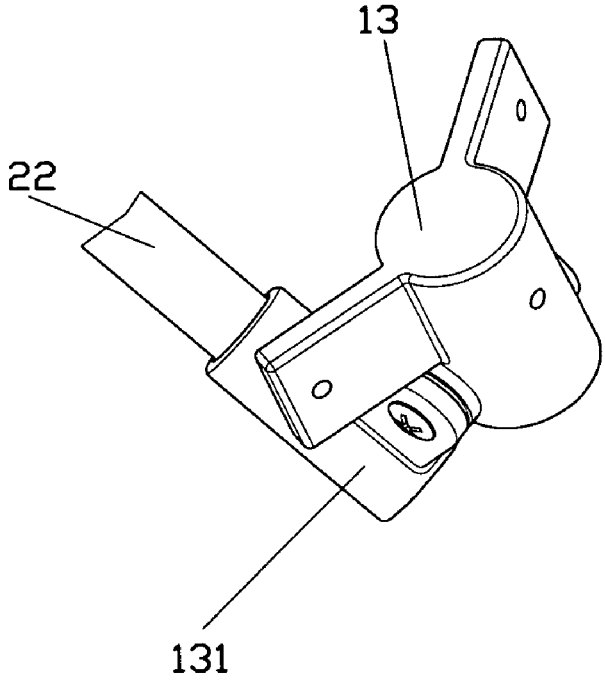
FIG. 4 is another schematic view of the adjustable top frame inclination of the present invention on the locking joint.

Upon adjusting the inclination of the top frame as illustrated in FIGS. 3 and 4, the inclination between the top frame (2) and the central joint (21) is changed by rotating the bolts (3) that hold against the central joint (21). The inclination at the other end of the top rod (22) is automatically adjusted due to that the sleeve (131) is already pivoted to the locking joint (13).

Figure 5:
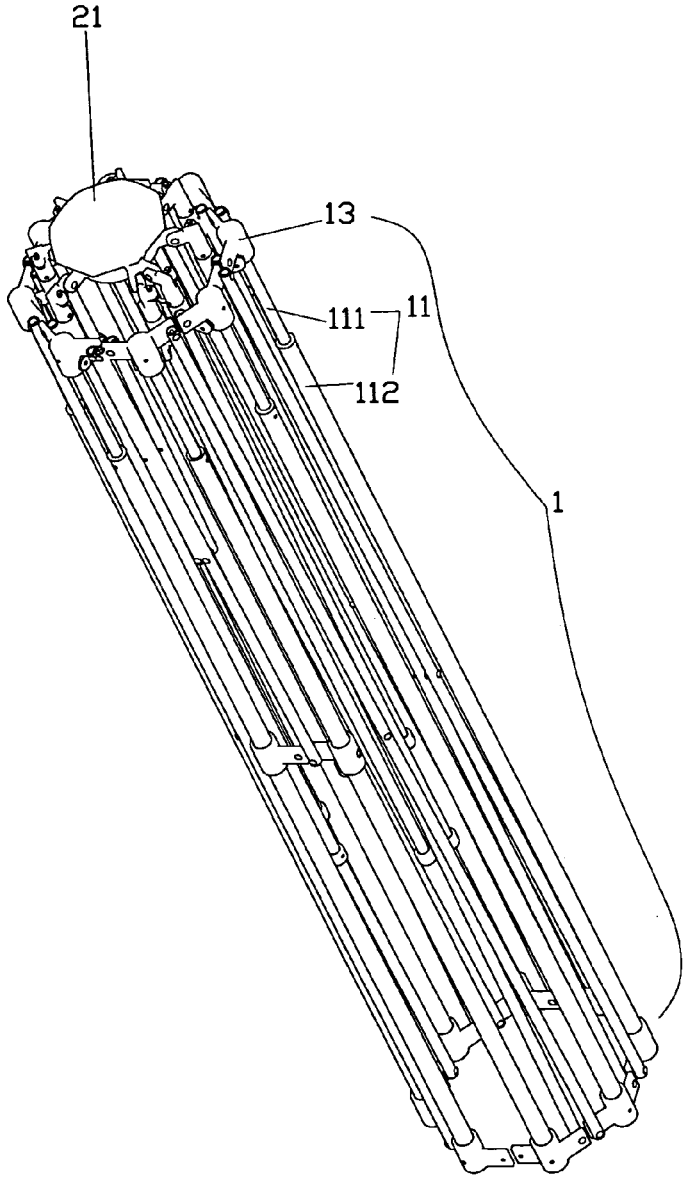
FIG. 5 is a schematic view showing that the present invention is retracted for storage.

Now referring to FIG. 5 when the present invention is retracted for storage, both the enclosure frame (1) and the top frame (2) are folded in together; the foldable connection rod units (12, 12A) are retracted; the upper poles (111) and the lower poles (112) are relatively extended; the top rods (22) on the top frame (2) are folded in together with the enclosure frame (1), and the top frame (2) is received in the central area of the enclosure frame (1) to save the space for easy storage.

In application as aforesaid, the present invention may operate only as an enclosure by selecting the enclosure frame (1) or as a roofed pet house when added with the top frame (2) and the tent (4) as illustrated in FIG. 6.

What is claimed is:

1. A retractable pet house comprising an enclosure frame and a top frame; the enclosure frame including a plurality of poles, foldable connection rod units, locking joints and doorframe joints; each pole including an upper end and a lower end; each pole comprising an upper pole and a lower pole; the upper pole being inserted into the lower pole to become retractable; the upper end and the lower end of each pole being respectively fixed to relative locking joints; the locking joint provided at the upper end of each pole being provided with a sleeve; the poles being alternatively distributed; the foldable connection rod units being pivoted to one another by means of connection rods; each foldable connection rod unit including on each side an upper end and a lower end respectively pivoted to the locking joints at the upper and the lower ends of the pole; the top frame including a central joint and a plurality of top rods; each top rod including two ends with one end pivoted to the central joint and another end penetrating through the sleeve pivoted to the locking joint at the upper end of the pole, wherein one of the foldable connection rod units includes two longer rods and two shorter rods; and the doorframe joints being fixed to the lower poles of the poles; each longer rod including an upper end, a middle section, and a lower end; each shorter rod including an upper end and a lower end; the longer rods being pivoted to each other at their upper ends; the lower ends of the shorter rods being pivoted to the middle sections of the longer rods; the upper ends of the shorter rods being the upper ends of the foldable connection rod unit; the lower ends of the longer rods being the lower ends of the foldable connection rod unit; the lower ends of the longer rods being pivoted to the door frame joints; wherein a threaded hole is provided at one end of each top rod for receiving a bolt to hold against the central joint; and the inclination between the top frame and the central joint being variable by rotating the bolts.

* * * * *